US011008194B1

(12) United States Patent
Jordan et al.

(10) Patent No.: US 11,008,194 B1
(45) Date of Patent: May 18, 2021

(54) PORTABLE RACK FOR HOLDING COILS OF WINDABLE MATERIAL

(71) Applicants: David S. Jordan, Knoxville, TN (US); Michael C. Jordan, Knoxville, TN (US)

(72) Inventors: David S. Jordan, Knoxville, TN (US); Michael C. Jordan, Knoxville, TN (US)

(73) Assignee: iTool Equipment Holding LLC, Clinton, TN (US)

( * ) Notice: Subject to any disclaimer, the term of this patent is extended or adjusted under 35 U.S.C. 154(b) by 0 days.

(21) Appl. No.: 16/602,372

(22) Filed: Sep. 25, 2019

Related U.S. Application Data

(60) Provisional application No. 62/766,017, filed on Sep. 26, 2018.

(51) Int. Cl.
*B65H 49/32* (2006.01)
*B65H 75/22* (2006.01)
*B65H 75/40* (2006.01)

(52) U.S. Cl.
CPC ..... *B65H 75/22* (2013.01); *B65H 75/40* (2013.01); *B65H 49/324* (2013.01)

(58) Field of Classification Search
CPC ..... B65H 75/22; B65H 75/40; B65H 49/32; B65H 49/321; B65H 49/325
See application file for complete search history.

(56) References Cited

U.S. PATENT DOCUMENTS 442,309 A * 12/1890 Diamond et al. ..... B65H 49/30 242/574.3
1,593,781 A * 7/1926 See ..... B65H 75/22 242/577
2,957,644 A * 10/1960 Beardslee ..... B65H 49/32 242/594.6
3,920,194 A * 11/1975 Parsen ..... B65H 49/321 242/591
4,995,578 A * 2/1991 Monheim ..... E06C 7/14 182/129
5,806,787 A * 9/1998 Schneider ..... B65H 49/325 242/129.5
7,261,271 B1 * 8/2007 Buswell ..... B65H 49/321 242/129.7
9,409,744 B2 * 8/2016 Jordan ..... B65H 75/02
9,718,638 B2 * 8/2017 Guiffault ..... B65H 49/325
(Continued)

*Primary Examiner* — Kimberly S Wright
(74) *Attorney, Agent, or Firm* — Michael E. McKee

(57) ABSTRACT

A portable rack for holding windable material, such as cable or wire, includes two elongated leg sections which are joined together at the upper ends thereof for pivotal movement between a folded condition at which the lower ends of the leg sections are disposed adjacent one another and an unfolded condition at which the lower ends of the leg sections are in a spaced-apart relationship. A two-ended rod is attachable to one leg section so that each of the two ends of the rod is capable of supporting a coil of windable material directed thereover. In addition, a plate member is secured to one of the leg sections adjacent the upper end thereof and defines an abutment edge for limiting the movement of the lower ends of the leg sections further apart during an unfolding operation to a distance as measured between the lower ends of the leg sections when in the unfolded condition.

15 Claims, 5 Drawing Sheets

(56) References Cited

U.S. PATENT DOCUMENTS

| | | | | |
|---|---|---|---|---|
| 10,676,310 | B2 * | 6/2020 | Rodriguez | B65H 49/321 |
| 2002/0074447 | A1 * | 6/2002 | Schneider | B65H 57/26<br>242/566 |
| 2005/0103730 | A1 * | 5/2005 | Hosilyk | A47F 7/17<br>211/85.5 |
| 2006/0086862 | A1 * | 4/2006 | Konkel | B65H 49/327<br>242/594.5 |
| 2015/0259173 | A1 * | 9/2015 | Guiffault | B65H 49/325<br>242/401 |
| 2016/0145069 | A1 * | 5/2016 | Jordan | B65H 49/32<br>242/596.7 |
| 2020/0062532 | A1 * | 2/2020 | Rodriguez | B65H 49/321 |

* cited by examiner

PORTABLE RACK FOR HOLDING COILS OF WINDABLE MATERIAL

The benefit of Provisional Application Ser. No. 62/766,017, filed Sep. 26, 2018 and entitled PORTABLE RACK FOR HOLDING COILS OF WINDABLE MATERIAL, is hereby claimed. The disclosure of this referenced provisional application is incorporated herein by reference.

BACKGROUND OF THE INVENTION

This invention relates generally to material-handling accessories and relates, more particularly, to racks upon which coils of windable material, such as cable or wire, can be supported.

It would be desirable to provide a material-handling rack for holding coils of cable or wire which improves upon the designs of this class of racks of the prior art.

Accordingly, it is an object of the present invention to provide a new and improved rack for supporting coils of cable or wire.

Another object of the present invention to provide such a rack which is capable of supporting coils of cable or wire in a condition facilitating the unwinding of the coils of cable or wire at a worksite.

Still another object of the present invention is to provide such a rack which can be readily folded between a condition for storage and a condition for use.

Yet another object of the present invention is to provide such a rack which is comprised of relatively few components.

A further object of the present invention is to provide such a rack which is compact and relatively light in weight.

A still further object of the present invention is to provide such a rack which is uncomplicated in structure, yet effective in operation.

SUMMARY OF THE INVENTION

This invention resides in a rack for holding windable material, such as cable or wire.

The rack includes two elongated leg sections wherein each leg section has a lower end for engaging the underlying floor and an opposite upper end. In addition, the two leg sections are joined together at the upper end thereof for pivotal movement between a folded condition at which the lower ends of the leg sections are disposed adjacent one another in a side-by-side relationship and an unfolded condition at which the lower ends of the leg sections are moved apart to positions which are appreciably spaced from one another. The rack also includes a two-ended rod which is attachable to one leg section intermediate of the upper and lower ends thereof so that the two ends of the rod extend from the one leg section and each end of the rod is capable of supporting a coil of windable material directed over an end of the rod. Furthermore, a first of the two leg sections includes a stop member disposed adjacent the upper end thereof and which is adapted to cooperate with the upper end of the second of the two leg sections so that as the lower ends of the two leg sections are pivotally moved apart from the folded condition toward the unfolded condition, the movement of the lower ends of the leg sections is limited by the stop member to the spaced-apart distance as measured between the lower ends of the leg sections when in the unfolded condition.

DETAILED DESCRIPTION OF AN ILLUSTRATIVE EMBODIMENT

Figure 1:
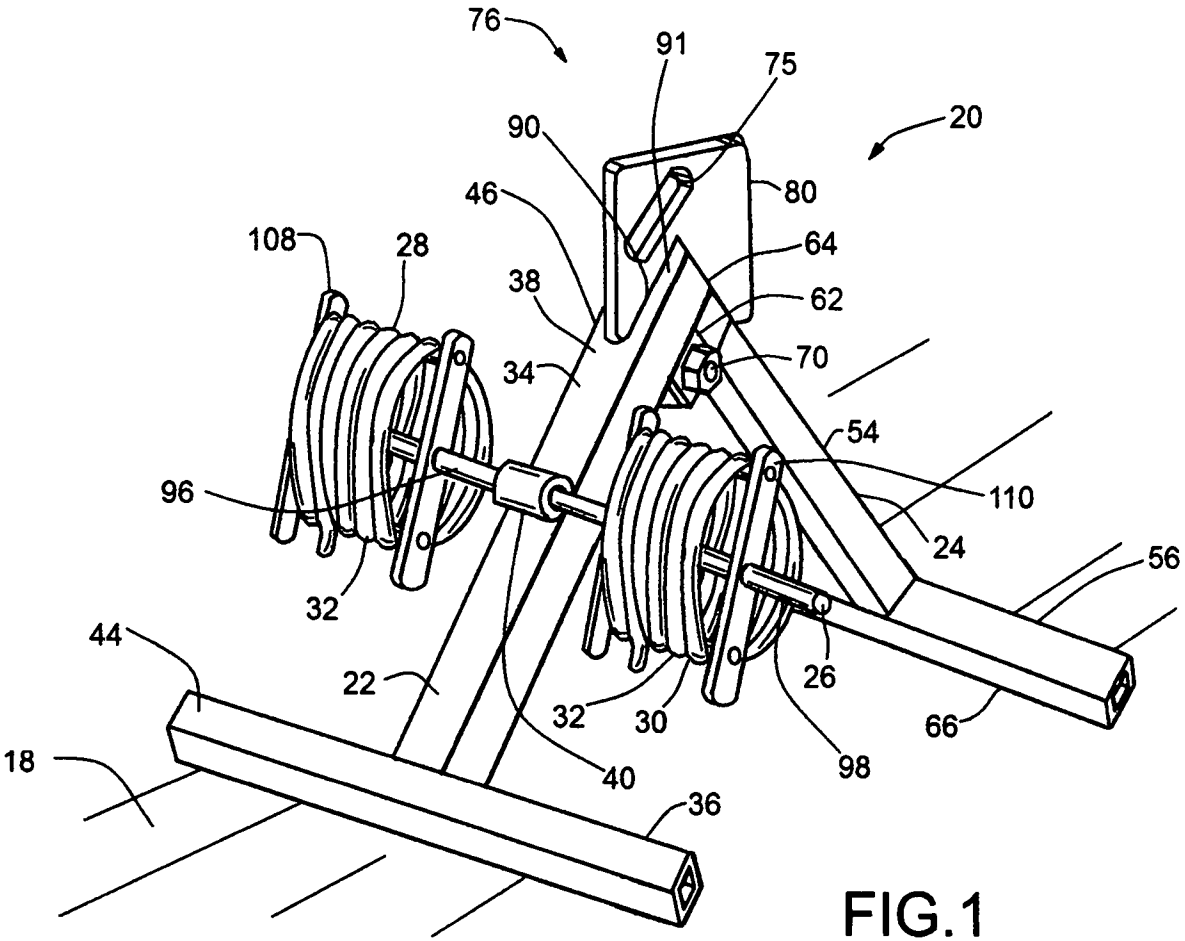
FIG. 1 is a perspective view of a portable rack within which features of the invention are embodied and shown being utilized for supporting a pair of coils of windable material.
Figure 2:
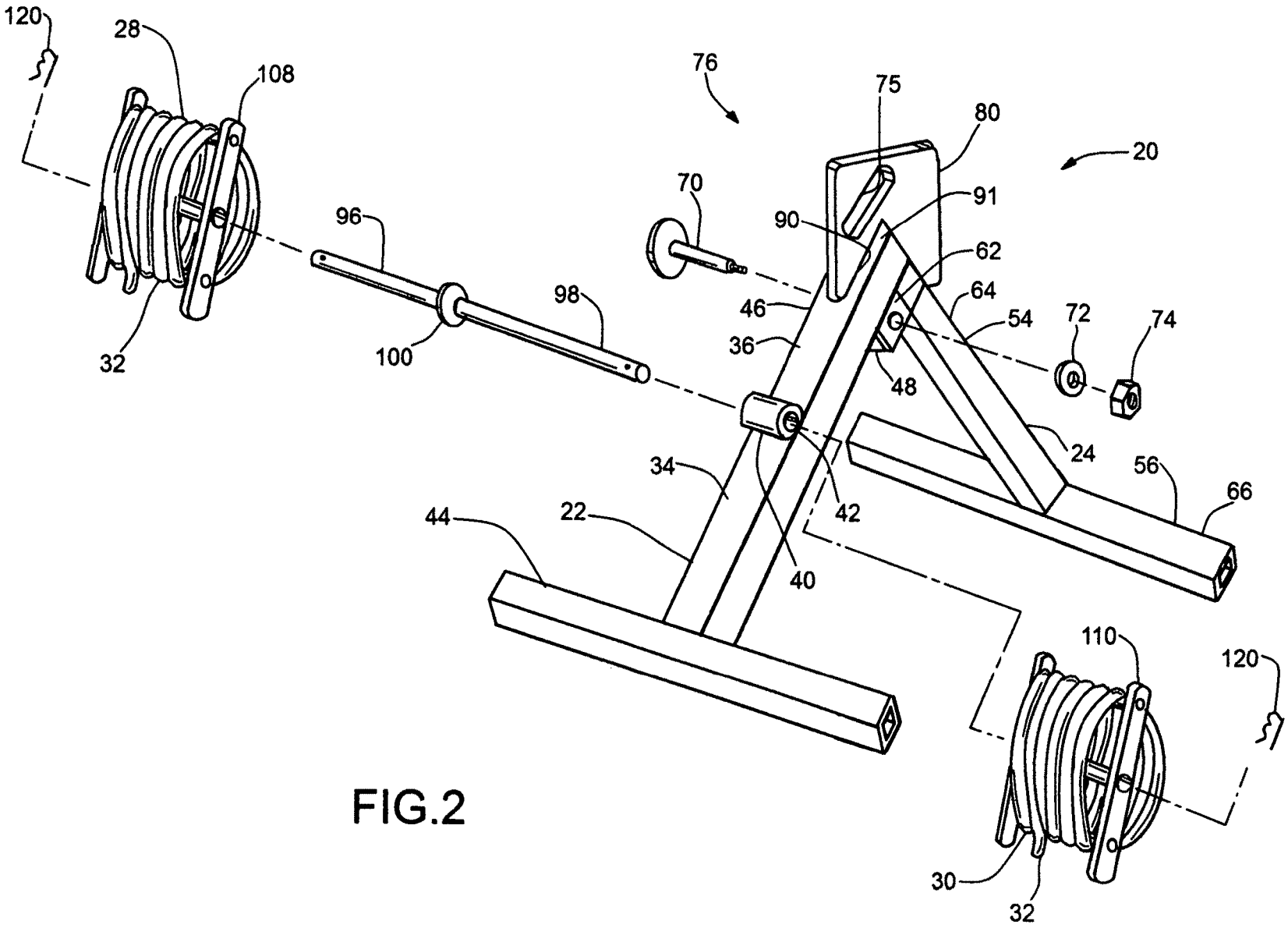
FIG. 2 is a perspective view of the portable rack and coils of FIG. 1, shown exploded.

Turning now to the drawings in greater detail and considering first FIGS. 1 and 2, there is illustrated an embodiment, generally indicated 20, of a rack within which features of the present invention are embodied. Briefly, the rack 20 includes a pair of leg sections 22, 24 which are hingedly connected together and a two-ended rod 26 which is secured to the leg section 22 so that the two ends of the rod 26 extend from the leg section 22 in opposite directions therefrom. Each of the two ends of the rod 26 which provides a support upon which a coil 28 or 30 of windable material 32, such as cable or wire, wound cable 32 can be directed endways thereon.

With reference to FIGS. 1-4, one leg section 22 includes a first elongated portion 34 and a second elongated portion 36 which are joined, or welded, together to form a T shape wherein the first elongated portion 34 provides the leg of the T-shape. As referred to herein, the elongated portion 36 provides the lower end, indicated 44, of the leg section 22 while the end, indicated 38, of the first elongated portion 34 provides an upper end, indicated 46, of the leg section 22. In addition, there is provided a collar member 40 having a through-opening 42 provided therein and which is fixedly joined, as with welds, to one side of the first intermediate portion 34 intermediate of the upper and lower ends 46, 44, respectively. As will be apparent herein, the collar member 40 enables the rod 26 to be joined to and supported by the leg section 22.

The leg section 22 also includes a lug portion 48 which is joined to the first leg portion 34 adjacent the upper end 46 thereof and so as to extend rearwardly, with reference to FIG. 2, of the first elongated portion 34. The lug portion 48 has an opening which extends horizontally therethrough, and it is with this lug portion 48 that the leg section 22 is pivotally connected to the other leg section 24.

The other leg section 24 includes a first elongated portion 54 and a second elongated portion 56 which are joined, or welded, together to form a T-shape wherein the first elongated portion 54 provides the leg of the T-shape. As referred to herein, the elongated portion 56 provides the lower end, indicated 66, of the leg section 24 while the end, indicated 58, of the first elongated portion 54 opposite the second elongated portion 56 provides an upper end, indicated 64, of the leg section 24. In addition, a pair of flanges 62 (only one shown in FIGS. 1 and 2) are joined to the first elongated portion 54 adjacent the upper end 64 of the leg section 24, and these flanges 62 are provided with horizontally-extending through-openings therein.

Figure 2A:
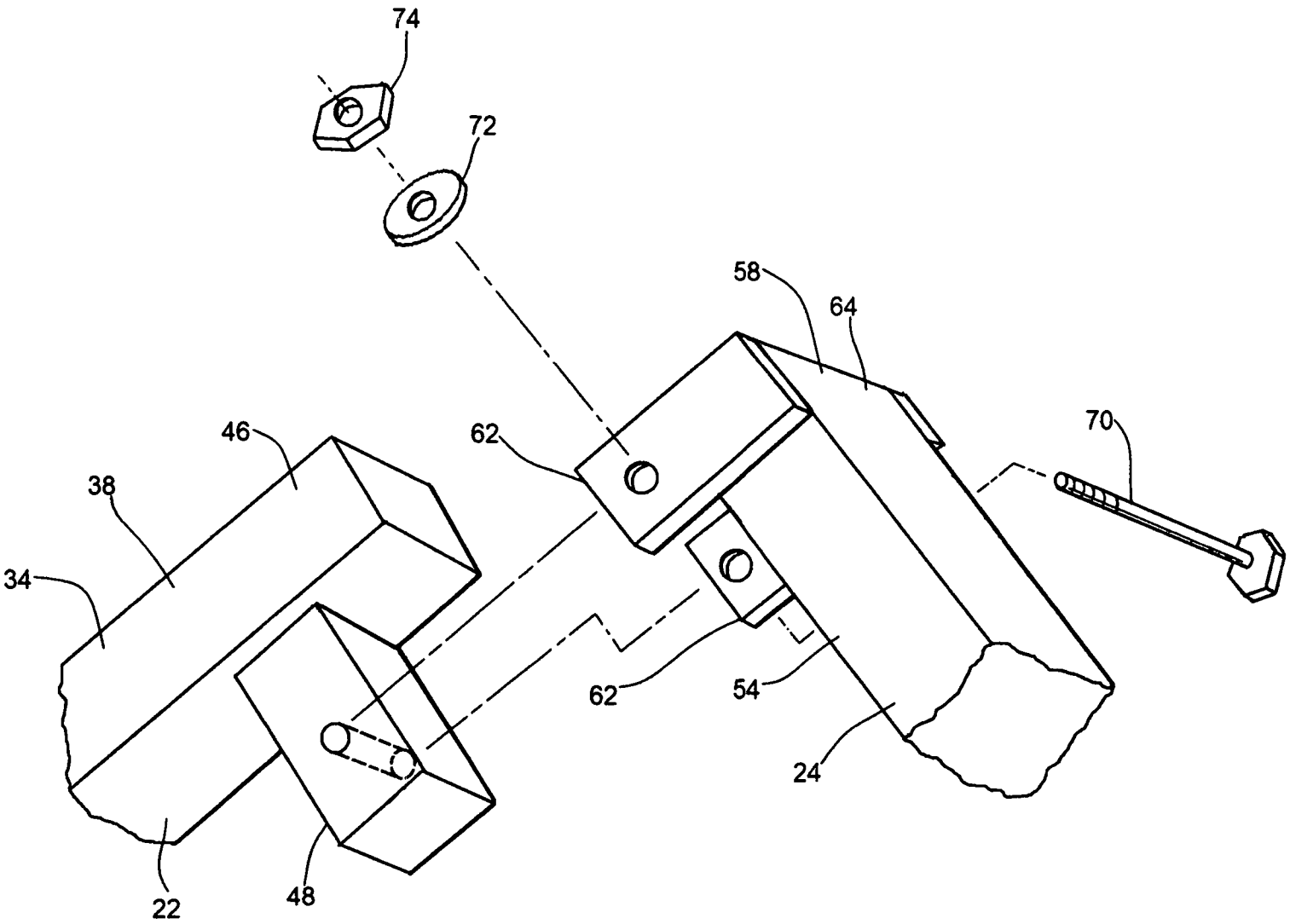
FIG. 2*a* is a perspective view of the upper ends of the leg sections of the FIG. 1 rack, shown exploded.

With reference to FIG. 2*a* and for joining the leg sections 22, 24 together, the lug portion 48 of the leg section 22 is positioned between the flanges 62 of the leg section 24 so that the through-openings of the lug portion 48 and flanges 62 are aligned. At that point, the shank of a bolt 70 is directed endwise through the aligned openings of the flanges 62 and lug portion 48, and a washer 72 and nut 74 are tightened upon the shank of the bolt 70 for pivotally securing the leg sections 22, 24 together. As will be apparent herein, the leg sections 22 and 24 are intended to be pivotally moved relative to one another about the shank of the bolt 70. Accordingly, the nut 74 is not tightened to such an extent about the shank of the bolt 70 so as to prevent the leg sections 22 and 24 from being pivoted relative to one another.

Figure 4:
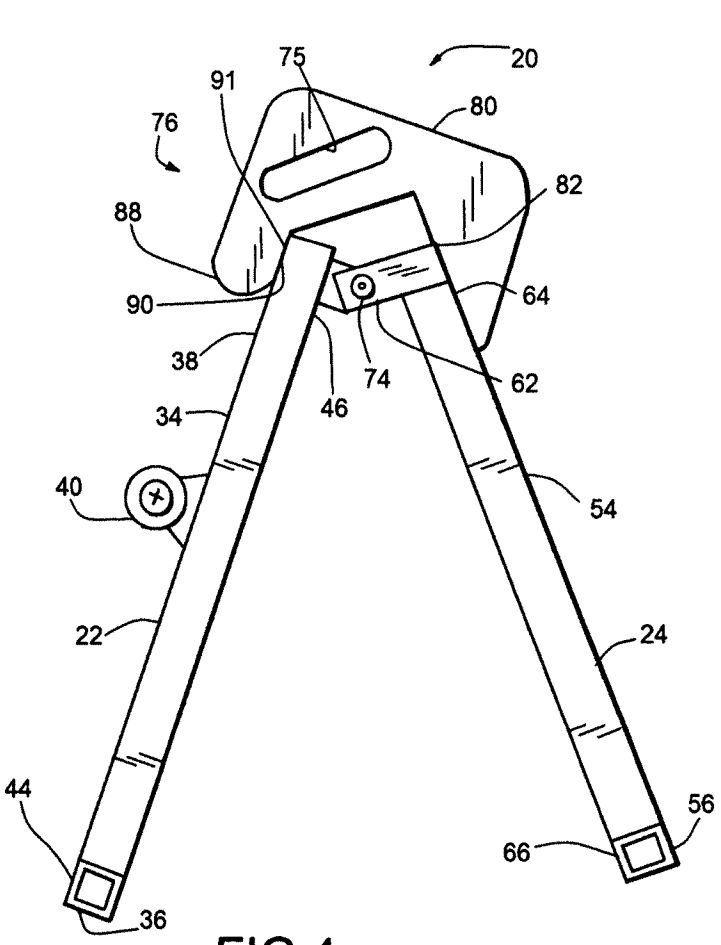
FIG. 4 is a side view of the pivotally-connected leg sections of the FIG. 1 rack, shown in an unfolded condition.

It is a feature of the present invention that when joined together as aforedescribed, the leg sections 22, 24 of the rack 20 are pivotally movable between a folded condition (as best shown in 3) at which the lower ends 44, 66 of the leg sections 22, 24 are disposed relatively close to one another in a side-by-side relationship and an unfolded condition (as best shown in FIG. 4) at which the lower ends 44, 66 of the leg sections 22, 24 are moved apart to positions at which the lower ends 44, 66 of the leg sections 22, 24 are appreciably spaced from one another. In this spaced-apart, or unfolded condition, the lower ends 44, 46 of the leg sections 22, 24 of the rack 20 can be placed upon the floor 18 (FIG. 1) or underlying support surface for supporting the rack 20 (and any coil 28 or 30 supported thereby) in a stable condition. Moreover, when the lower ends 44, 46 of the leg sections 22, 24 are positioned upon the underlying floor 18, the second elongated portions 36, 56 of the leg sections 22, 24 engage the floor 18 along the entirety of the length of the second elongated portions 36, 56.

Figure 3:
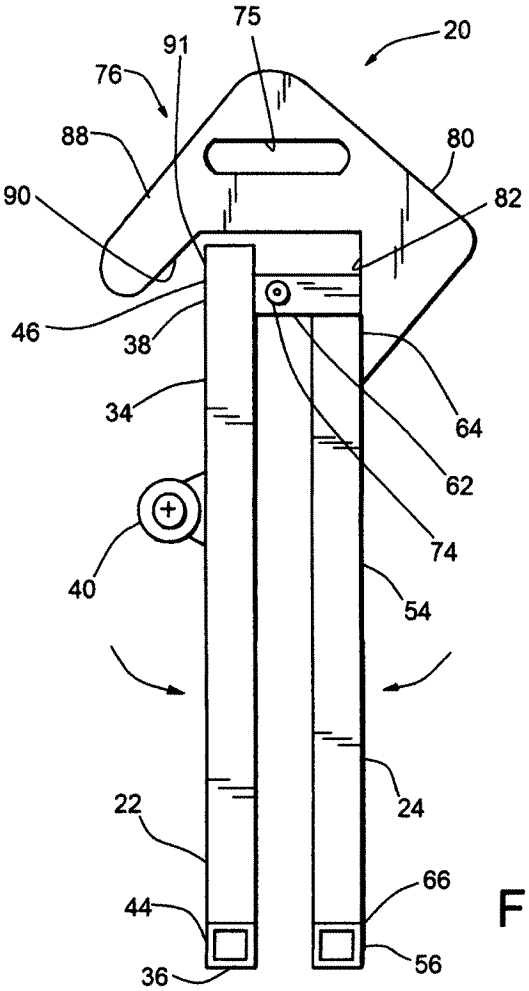
FIG. 3 is a side elevational view of the pivotally-connected leg sections of the FIG. 1 rack shown in a folded condition.

It is a feature of the rack 20 that it includes stop means, generally indicated 76, for limiting the movement of the lower ends 46, 66 of the leg sections 22, 24 apart when the leg sections 22, 24 are moved from the FIG. 3 folded condition toward the FIG. 4 unfolded condition. In other words, as the lower ends 46, 66 of the leg sections 22, 24 are moved apart, the stop means 76 prevents the movement of the lower ends 46, 66 of the leg sections 22, 24 any further apart than the spaced-apart distance of the lower ends 46, 66 when in the FIG. 4 unfolded condition. As the rack 20 is being used to hold the coils 28, 30 above the floor 18, the stop means 76 prevents the lower ends 46, 66 of the legs from spreading or splaying apart any further under the weight of the coils 28, 30.

Within the depicted rack 20, the stop means 76 includes a plate member 80 which is joined along one of its edges 82 to the first elongated portion 54 of the upper end of the leg section 24 adjacent the upper end 64 thereof. A best seen in FIGS. 3 and 4, the plate member 80 is somewhat square in appearance having rounded corners, and one rounded corner, indicated 88, of the plate member 80 is shaped to provide an abutment edge 90 which is positioned adjacent an outer surface, indicated 91, of the first elongated portion 34 of the leg section 22. When the leg sections 22, 24 are in the FIG. 3 folded condition, the abutment edge 90 is spaced from the outer surface 91 of the first elongated portion 34. However, upon movement of the lower ends 46, 66 of the leg sections 22, 24 further apart (from the FIG. 3 folded condition), the outer surface 91 of the first elongated portion 34 of the leg section 22 eventually abuts the abutment edge 90 of the plate member 80 so that movement of the lower ends 46, 66 of the leg sections 22, 24 further apart than the spaced-apart distance of the lower ends 46, 66 when in the FIG. 4 unfolded condition is prevented.

To facilitate the transport of the rack 20 between job sites, an opening 75 has been formed within the plate member 80 to provide the plate member 80 with a hand grip with which the rack 20 can be conveniently carried by a user. In this connection, when the plate member 80 is grasped for lifting purposes, the opening 75 provides a passageway through which the user's fingers are permitted to pass.

With reference again to FIGS. 1 and 2, the rod 26 is cylindrical in shape and has two opposite ends 96 and 98. Secured medially about the rod 26 is a collar 100 which provides a means by which the rod 26 can be positioned within the collar member 40 so that the ends 96, 98 of the rod 26 extend by about an equal distance from the leg section 22. That is to say that the collar 100 is located substantially midway along the length of the rod 26 so that when one end 96 or 98 is inserted endways into the through-opening 42 of the collar member 40 until the collar 100 abuts one side of the collar 100, the ends 96 and 98 extend away from opposite sides of the leg section 22 by about an equal amount.

Figure 6:
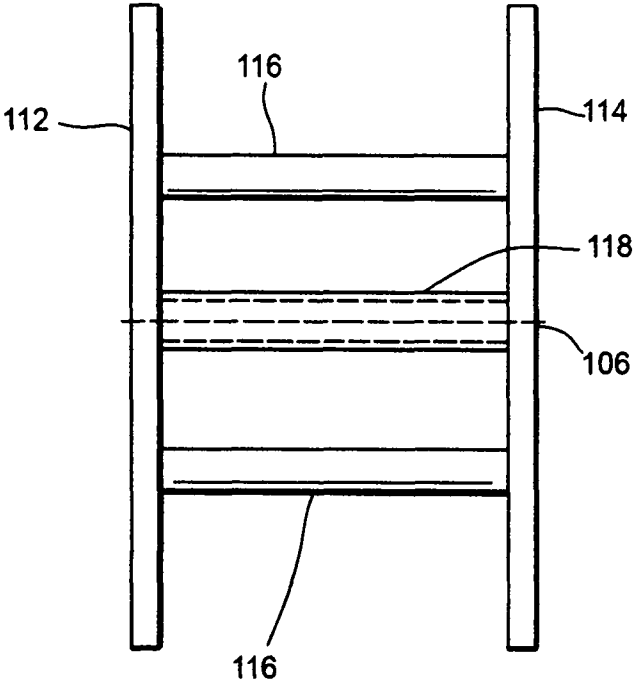
FIG. 6 is a plan view of the rack of FIG. 1, as seen generally from above in FIG. 5.
Figure 5:
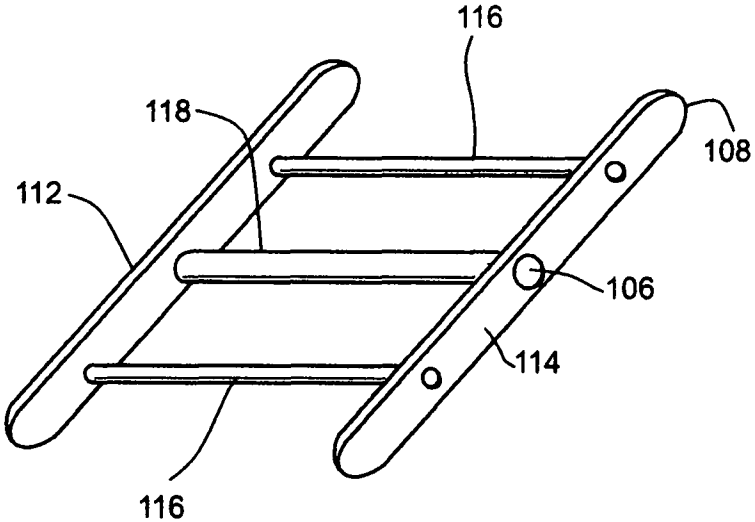
FIG. 5 is a perspective view of a frame capable of use with the FIG. 1 rack and about which a coil of windable material can be wound.

Each of the coils 28 or 30 of FIG. 1 have been wound about a corresponding frame of two frames 108, 110 which have each been sized to be supported about an end 96 or 98 of the rod 26. As exemplified by the frame 108 of FIGS. 5 and 6, each frame 108 or 110 includes a pair of elongated side plates 112, 114 which are arranged in a parallel relationship with one another and are maintained in such a parallel relationship with a pair of cylindrical struts 116 and a central tube 118. The side plates 112, 114 define a pair of openings 106 for a reason which will be apparent herein. Meanwhile, the tube 118 has an interior opening which is sized to accept an end 96 or 98 of the rod 26 when the frame 108 or 110 is directed thereover. The tube 118 is positioned between the side plates 112, 114 so that the interior opening of the tube 118 is aligned with the aligned openings 106 formed with the side plates 112, 114, and the opposite ends of the tube 118 are secured (e.g. welded) to the side plates 112, 114 to maintain the interior opening of the tube 118 in an aligned relationship with the openings 106 of the side plates 112, 114.

In addition, the cylindrical struts 116 are positioned so as to extend between the side plates 112, 114 and are joined, e.g. welded, at the opposite ends thereof to the side plates 112, 114. Within the depicted frames 108, 110, the struts 116 are arranged in a spaced-apart condition (and spaced substantially equi-distant from the tube 118) to provide an effectively-sized core about which a cable or wire can be wound. Once a frame 108 or 110 is positioned about the ends 96, 98 of the rod 26, the frames 108, 110 can be retained thereon with a cotter key 120 (FIG. 2).

Each component of the rack 20 and frames 108 and 110 is preferably constructed of steel, but other materials can be used.

A rack 20 which possesses the aforedescribed features can possess the following exemplary dimensions (when placed upon an underlying floor 18 in an unfolded condition): an overall length of about twenty-six inches (as measured across the second elongated portions 36, 56 of the leg sections 22, 24; a width of about twenty-nine inches (as measured along the length of either of the second elongated portions 36, 56; and a height of about 19.5 inches (as measured from the floor 18 to the top of the plate member 80). Furthermore, the angle formed between the first and second elongated portions 34 and 54 of the first and second leg sections 22 and 24 is about ninety degrees.

It will be understood that numerous modifications and substitutions can be had to the aforedescribed embodiment 20 without departing from the spirit of the invention. Accordingly, the aforedescribed embodiment 20 is intended for the purpose of illustration and not as limitation.

The invention claimed is:

1. A rack for holding windable material, such as cable or wire, the rack comprising:

two elongated leg sections wherein each leg section has a lower end for engaging the underlying floor and an opposite upper end, and wherein the two leg sections are joined together at the upper end thereof for pivotal movement relative to one another about a pivot axis between a folded condition at which the lower ends of the leg sections are disposed adjacent one another in a side-by-side relationship and an unfolded condition at which the lower ends of the leg sections are moved apart to positions at which the lower ends of the leg sections are appreciably spaced from one another;

a two-ended rod which is attachable to one leg section at a location disposed along the upper end thereof so that the two ends of the rod extend away from the one leg section and each end of the rod is capable of supporting a coil of windable material directed over an end of the rod with no need to remove the rod from the remainder of the rack before a coil of windable material is directed over an end of the rod; and a stop member connected to a first of the leg sections and disposed adjacent the upper ends of the leg sections and which is adapted to cooperate with the upper ends so that as the lower ends of the two leg sections are pivotally moved apart from the folded condition toward the unfolded condition, the movement of the lower ends of the two leg sections relative to one another is limited by the stop member to the spaced-apart distance as measured between the lower ends of the two leg sections when in the unfolded condition; and wherein the stop member is in the form of a plate which is arranged in a plane which is substantially normal to the pivot axis and defines a cutout having two opposing edges which are arranged outboard of the upper ends of the two leg sections so that when the lower ends of the two leg sections are pivotally moved apart from the folded condition to the unfolded condition, the upper ends of the two leg sections act against the opposing edges of the cutout so that the movement of the lower ends of the two leg sections is limited to said spaced-apart distance.

2. The rack as defined in claim 1 wherein the plate defines an opening therethrough enabling the plate to act as a handle with which the rack can be lifted for transport.

3. The rack as defined in claim 1 wherein the rack has two opposite sides and further comprises a collar member having an opening therethrough and which is attached to one of the two leg sections of the rack so that the opening of the collar member opens away from the sides of the rack, and the two-ended rod which is positionable within the collar member by inserting the rod endwise through the opening of the collar member.

4. The rack as defined in claim 1 wherein the lower ends of each of the two leg sections includes an elongated portion having a length and so that when the rack is positioned upon a floor for use, the elongated portions engage the floor.

5. The rack as defined in claim 4 wherein the elongated portions of the two leg sections are adapted to engage the floor along the entirety of the length of the elongated portions.

6. The rack as defined in claim 1 wherein the first and second leg portions form an angle of about ninety degrees when the rack is in an unfolded condition.

7. The rack as defined in claim 1 in combination with a frame about which a windable material can be wound, and wherein the frame includes a centrally-disposed hollow tube having an interior sized to accept an end of the two-ended rod when the interior of the tube is directed over an end of the rod.

8. A rack for holding a frame about which windable material can be wound and wherein the frame includes a central opening provided therein, the rack comprising:

two elongated leg sections wherein each leg section is in the form of an inverted T and has a lower end for engaging the underlying floor and an opposite upper end, and wherein the upper ends of the leg sections are joined together for pivotal movement relative to one another about a pivot axis between a folded condition at which the lower ends of the leg sections are disposed adjacent one another and an unfolded condition at which the lower ends of the leg sections are moved further apart to positions at which the lower ends of the leg sections are appreciably spaced from one another;

a two-ended rod which is attachable to one leg section at a location disposed along the upper end thereof so that the two ends of the rod extend away from the one leg section and are each capable of accepting the central opening provided in a frame about which windable material can be wound with no need to remove the rod from the remainder of the rack before the central opening of the frame is directed over an end of the rod; and a stop member connected to a first of the leg sections and disposed adjacent the upper ends of the leg sections for limiting the movement of the lower ends of the two leg sections away from one another to a predetermined distance; and wherein the stop member is in the form of a plate which is arranged in a plane which is substantially normal to the pivot axis and defines a cutout having two opposing edges which are arranged outboard of the upper ends of the two leg sections so that when the lower ends of the two leg sections are pivotally moved apart from the folded condition to the unfolded condition, the upper ends of the two leg sections act against the opposing edges of the cutout to limit the movement of the lower ends of the two leg sections away from one another to said predetermined distance.

9. The rack as defined in claim 8 wherein the plate defines a hand-accepting opening therethrough enabling the plate to act as a handle with which the rack can be manually lifted for transport.

10. The rack as defined in claim 8 wherein the rack has two opposite sides and further comprises a collar member having an opening therethrough and which is attached to one of the two leg sections of the rack so that the opening of the collar member opens away from the sides of the rack, and the two-ended rod which is positionable within the collar member by inserting the rod endwise through the opening of the collar member.

11. The rack as defined in claim 8 wherein the lower ends of each of the two leg sections includes an elongated portion having a length and so that when the rack is positioned upon a floor for use, the elongated portions engage the floor.

12. The rack as defined in claim 8 wherein the first and second leg portions form an angle of about ninety degrees when the rack is in an unfolded condition.

13. The rack as defined in claim 8 in combination with a frame about which a windable material can be wound, and wherein the frame includes a centrally-disposed hollow tube having an interior sized to accept an end of the two-ended rod when the interior of the tube is directed over an end of the rod.

14. In combination, a frame about which windable material can be wound wherein the frame includes a hollow tube providing a central opening disposed substantially centrally of the frame and a rack for holding the frame wherein the rack includes two elongated leg sections wherein each leg section has a lower end for engaging the underlying floor and an opposite upper end, and wherein the upper ends of the leg sections are joined together for pivotal movement relative to one another about a pivot axis between a folded condition at which the lower ends of the leg sections are disposed adjacent one another and an unfolded condition at which the lower ends of the leg sections are moved further apart to positions at which the lower ends of the leg sections are appreciably spaced from one another;

a two-ended rod which is attachable to one leg section at a location disposed along the upper end thereof so that the two ends of the rod extend away from the one leg section and are each capable of accepting the central opening provided in the frame about which windable material can be wound for supporting the frame from the rack with no need to remove the rod from the remainder of the rack before the central opening of the frame is directed over an end of the rod; and a stop member connected to a first of the two leg sections and disposed adjacent the upper ends of the two leg sections for limiting the movement of the lower ends of the two leg sections away from one another to a predetermined distance; and wherein the stop member is in the form of a plate which is arranged in a plane which is substantially normal to the pivot axis and defines a cutout having two opposing edges which are arranged outboard of the upper ends of the two leg sections so that when the lower ends of the two leg sections are pivotally moved apart from the folded condition to the unfolded condition, the upper ends of the two leg sections act against the opposing edges of the cutout to thereby limit the movement of the lower ends of the two leg sections away from one another to said predetermined distance.

15. The combination as defined in claim 14 wherein the plate defines a hand-accepting opening therethrough enabling the plate to act as a handle with which the rack can be manually lifted for transport.

* * * * *